US008695461B2

(12) United States Patent
Moss et al.

(10) Patent No.: US 8,695,461 B2
(45) Date of Patent: Apr. 15, 2014

(54) CLEANABLE MAGNETIC NUT DRIVER

(75) Inventors: Darren Moss, York, PA (US); Michael Peters, Lutherville, MD (US); Mark Brunson, Bel Air, MD (US); Aland Santamarina, Columbia, MD (US); Glen Steinbrunner, Bel Air, MD (US)

(73) Assignee: Black & Decker Inc., Newark, DE (US)

( * ) Notice: Subject to any disclaimer, the term of this patent is extended or adjusted under 35 U.S.C. 154(b) by 85 days.

(21) Appl. No.: 12/975,599

(22) Filed: Dec. 22, 2010

(65) Prior Publication Data

US 2012/0160064 A1 Jun. 28, 2012

(51) Int. Cl.
*B25B 13/06* (2006.01)
*B25B 23/12* (2006.01)

(52) U.S. Cl.
USPC ..... 81/125; 81/438

(58) Field of Classification Search
USPC ..... 81/125, 123, 124.1, 124.4, 177.2, 438, 81/439, 451
See application file for complete search history.

(56) References Cited

U.S. PATENT DOCUMENTS

| | | | | |
|---|---|---|---|---|
| 291,961 | A * | 1/1884 | True | 81/124.1 |
| 1,323,056 | A * | 11/1919 | Hofmann | 7/138 |
| 1,388,979 | A | 8/1921 | Stewart et al. | |
| 1,490,739 | A | 4/1924 | Hewitt | |
| 1,509,680 | A | 9/1924 | Meek | |
| 1,579,072 | A | 3/1926 | Brouse | |
| 1,629,217 | A | 5/1927 | Largent | |
| 2,470,399 | A | 5/1949 | Holben | |
| 2,550,775 | A | 5/1951 | Clark | |
| 2,624,223 | A | 1/1953 | Clark | |
| 2,653,636 | A | 9/1953 | Younkin | |
| 2,671,369 | A | 3/1954 | Clark | |
| 2,671,484 | A | 3/1954 | Clark | |
| 2,677,294 | A | 5/1954 | Clark | |
| 2,714,829 | A | 8/1955 | Clark | |
| 2,718,806 | A | 9/1955 | Clark | |
| 2,720,804 | A | 10/1955 | Brown | |
| 2,750,828 | A | 6/1956 | Wendling | |
| 2,782,822 | A | 2/1957 | Clark | |
| 2,808,862 | A | 10/1957 | Simkins | |
| 2,834,241 | A | 5/1958 | Chowning | |
| 2,838,082 | A | 6/1958 | Lange | |
| 2,963,930 | A | 12/1960 | Troudt | |
| 3,007,504 | A | 11/1961 | Clark | |
| 3,114,278 | A | 12/1963 | Thomas | |
| 3,145,595 | A | 8/1964 | Massck | |
| 3,207,010 | A | 9/1965 | Wendling | |
| 3,222,959 | A | 12/1965 | Clark | |
| 3,227,015 | A * | 1/1966 | Tremblay | 81/177.2 |
| 3,392,767 | A | 7/1968 | Stillwagon, Jr. | |
| 3,633,640 | A | 1/1972 | Moore | |

(Continued)

FOREIGN PATENT DOCUMENTS

| | | |
|---|---|---|
| DE | 1746496 U | 6/1957 |
| DE | 1899797 U | 8/1964 |

(Continued)

OTHER PUBLICATIONS

Jason Wills—Retractable Nut Driver, www.inventionhome.com, Jun. 6, 2007.

*Primary Examiner* — Hadi Shakeri
(74) *Attorney, Agent, or Firm* — Scott B. Markow

(57) ABSTRACT

A magnet nut driver is provided with a cleanable magnet.

17 Claims, 13 Drawing Sheets

(56) References Cited

U.S. PATENT DOCUMENTS

| | | | | |
|---|---|---|---|---|
| 4,951,409 | A * | 8/1990 | Froid | 81/125 |
| 5,163,345 | A | 11/1992 | Doan et al. | |
| 5,168,782 | A | 12/1992 | Cromwell | |
| 5,249,489 | A * | 10/1993 | Weisman | 81/124.1 |
| 5,442,982 | A * | 8/1995 | Bell | 81/439 |
| 5,485,769 | A | 1/1996 | Olson et al. | |
| 5,752,418 | A | 5/1998 | Robins | |
| 5,860,338 | A | 1/1999 | Littlefield | |
| 5,916,340 | A | 6/1999 | Forsyth | |
| 6,176,654 | B1 | 1/2001 | Jore | |
| 6,354,177 | B2 | 3/2002 | Peters | |
| 6,397,707 | B1 * | 6/2002 | Tatarinov | 81/124.1 |
| 6,684,740 | B2 * | 2/2004 | Lin | 81/177.2 |
| 6,726,393 | B2 | 4/2004 | Tsai et al. | |
| 6,840,142 | B2 | 1/2005 | Cheng | |
| RE38,778 | E | 8/2005 | Eggert et al. | |
| 6,931,967 | B1 | 8/2005 | Chang et al. | |
| 6,959,629 | B2 * | 11/2005 | Hsien | 81/177.2 |
| 6,973,858 | B2 | 12/2005 | Huang | |
| 7,096,768 | B1 | 8/2006 | Chen | |
| 7,124,665 | B1 | 10/2006 | Chen | |
| 7,290,470 | B1 | 11/2007 | Peters | |
| 7,434,494 | B1 | 10/2008 | Snider | |
| 7,469,909 | B2 | 12/2008 | Strauch et al. | |
| 7,574,946 | B1 | 8/2009 | Chang | |
| 7,581,470 | B1 | 9/2009 | Huang | |
| 7,597,031 | B2 | 10/2009 | Chiang | |
| 7,654,175 | B2 | 2/2010 | Hamon | |
| 2003/0131694 | A1 * | 7/2003 | Lin | 81/438 |
| 2006/0254394 | A1 | 11/2006 | Cantlon et al. | |
| 2007/0234856 | A1 | 10/2007 | Liu | |
| 2011/0197718 | A1 | 8/2011 | Meholovitch | |

FOREIGN PATENT DOCUMENTS

| | | | |
|---|---|---|---|
| DE | 8401702.3 | U | 4/1984 |
| DE | 29617973 | U1 | 1/1997 |
| DE | 202007000714 | U1 | 4/2007 |
| GB | 2318316 | | 4/1998 |
| WO | 2007038082 | A1 | 4/2007 |

* cited by examiner

FIG 4
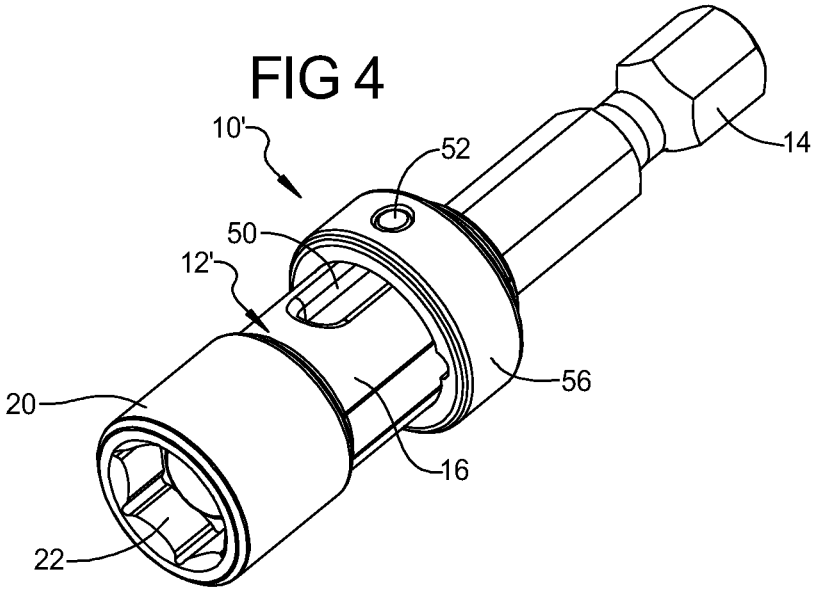
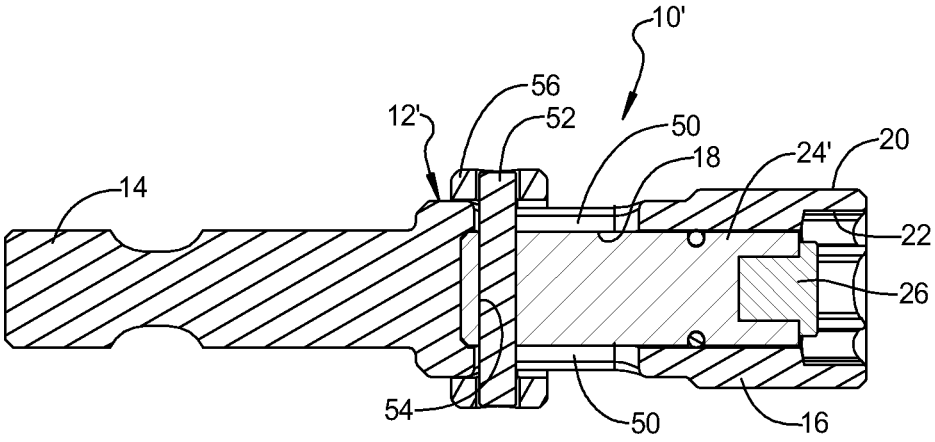
FIG 5

FIG 8
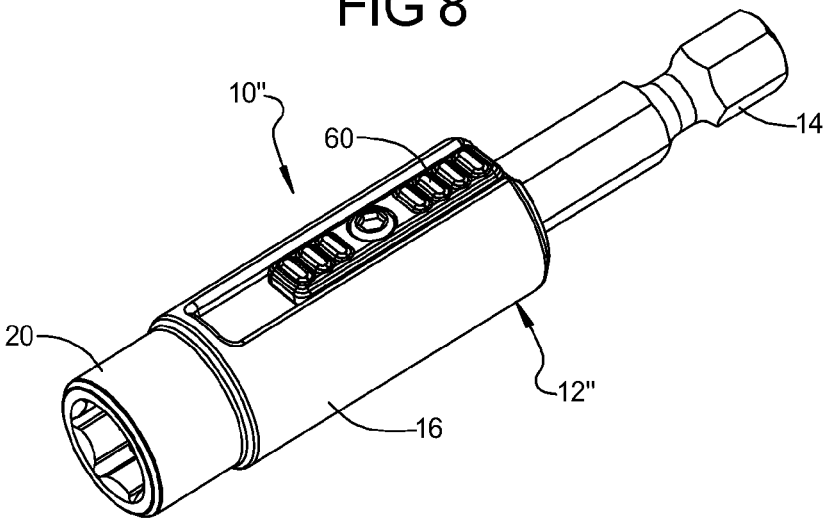
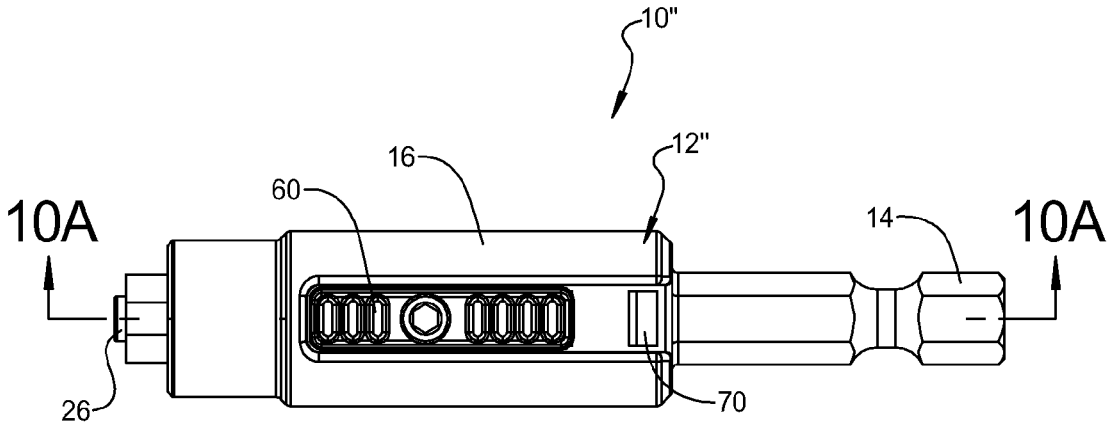
FIG 9A

FIG 12
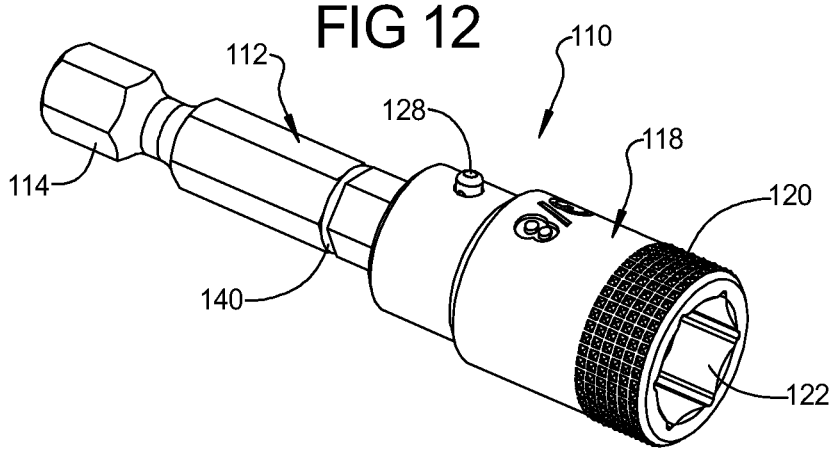
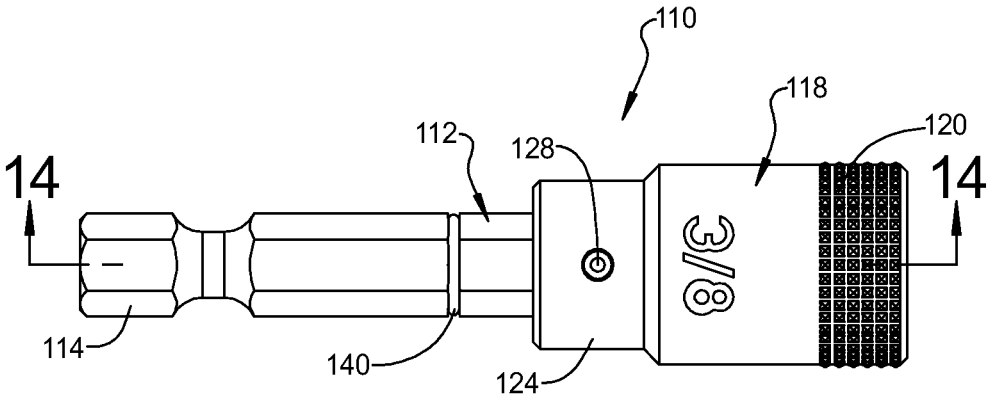
FIG 13
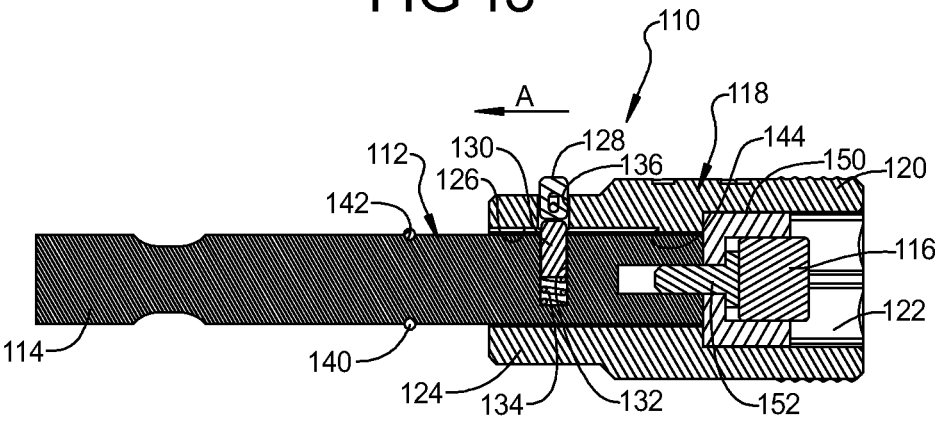
FIG 14

CLEANABLE MAGNETIC NUT DRIVER

FIELD

The present disclosure relates to nut drivers and more particularly, to a cleanable magnetic nut driver.

BACKGROUND

This section provides background information related to the present disclosure which is not necessarily prior art.

Magnetic nut drivers have been available for use with drill drivers and other power tools. The nut drivers are used for driving fasteners, e.g., nuts and screws having a polygonal-shaped, e.g., hex-shaped head. The use of the nut driver is far more convenient than the use of wrenches or sockets that are hand driven. With the improved capability of installing screws at a rapid rate, the accumulation of metal chips within the magnetic nut driver can prohibit a proper receipt of a screw head in the nut driver.

SUMMARY

This section provides a general summary of the disclosure, and is not a comprehensive disclosure of its full scope or all of its features.

The present disclosure provides a cleanable magnetic nut driver that allows the removal of metal chips from the magnet within the nut driver. According to one embodiment, a nut driver is provided including a shank having a rear portion configured to be coupled to a power tool. An intermediate portion defines an internal bore and a front portion defines a hex shaped socket in communication with the bore. A shaft is received in the bore and has a magnetic front portion. The shaft is slidable between a rearward position where the magnetic portion is disposed rearward of the socket, and a frontward position where the magnetic portion is exposed from the socket for cleaning. An actuator is provided external to the shank and fixably coupled to the shaft through a slot in a sidewall of the intermediate portion of the shank. The actuator is movable between a first position in which the actuator causes the shaft to move to the rearward position, and a second position in which the actuator causes the shaft to move to the frontward position for exposing the magnet for cleaning.

According to an alternative embodiment, a nut driver is provided including a shank having a rear portion configured to be coupled to a power tool and having a front magnetic portion. A sleeve is received over the shank and has a front portion defining a hex-shaped socket. A rear portion defines a bore in communication with the socket and which is received over the front magnetic portion of the shank. An actuator, external to the sleeve, is configured to prevent movement of the sleeve relative to the shank when not actuated, and is configured to enable movement of the sleeve relative to the shank when actuated. When the actuator is actuated, the sleeve is movable between a frontward position where the front magnetic portion is disposed rearward of the socket, and a rearward position where the magnetic portion is exposed from the socket for cleaning.

According to a still further alternative embodiment, a nut driver is provided including a shank having a rear portion configured to be coupled to a power tool and front magnetic portion. A driving portion includes a plurality of sleeves, each defining a bore and a hex-shaped socket forward of the bore, each hex-shaped socket having a different size. The driving portion is attachable to the shank in a plurality of orientations corresponding to the number of sleeves, such that in each orientation, the front magnetic portion is received inside the bore of one of the sleeves with the magnetic portion disposed rearward of the socket. The driving portion is removable from the shank to expose the magnetic portion for cleaning.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

FIG. 4 is a perspective view of a cleanable magnetic nut driver according to an alternative embodiment;

FIG. 5 is a cross-sectional view of the cleanable magnetic nut driver shown in FIG. 4 with the shaft having a magnetic front portion which is fully received within the bore;

FIG. 8 is a perspective view of a cleanable magnetic nut driver according to an alternative embodiment;

FIG. 9A is a plan view of the cleanable magnetic nut driver shown in FIG. 8, with the shaft having a magnetic front portion extended so as to be exposed from the socket for cleaning;

FIG. 12 is a perspective view of a cleanable magnetic nut driver according to an alternative embodiment;

FIG. 13 is a plan view of the cleanable magnetic nut driver shown in FIG. 12;

FIG. 14 is a cross-sectional view of the cleanable magnetic nut driver taken along lines 14-14 of FIG. 13;

Corresponding reference numerals indicate corresponding parts throughout the several views of the drawings.

DETAILED DESCRIPTION

Example embodiments will now be described more fully with reference to the accompanying drawings.

Figure 1:
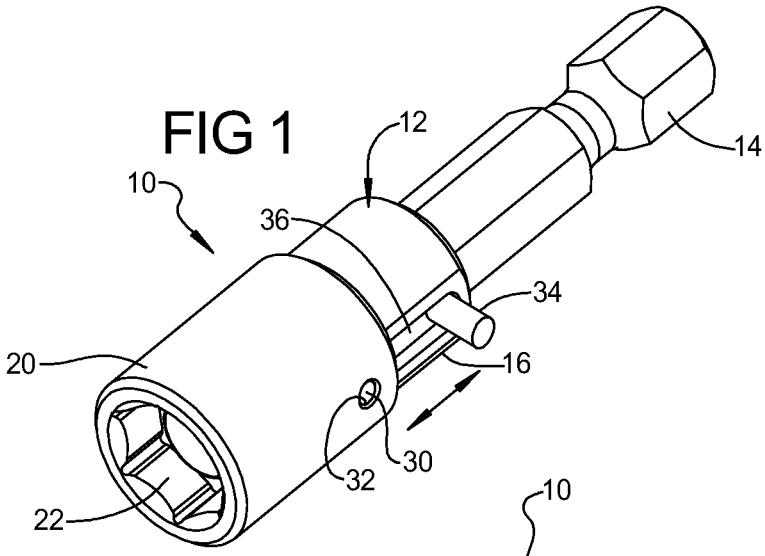
FIG. 1 is a perspective view of a cleanable magnetic nut driver according to the principles of the present disclosure.
Figure 2:
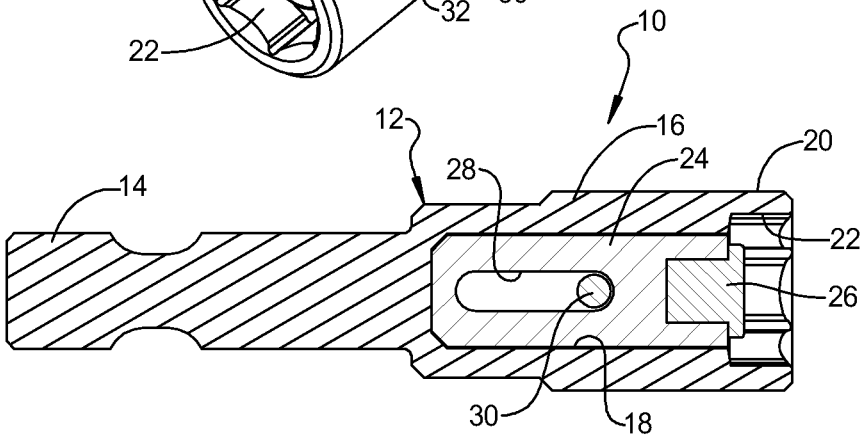
FIG. 2 is a cross-sectional view of the cleanable magnetic nut driver shown in FIG. 1 with the shaft having a magnetic front portion which is fully received within the bore.
Figure 3:
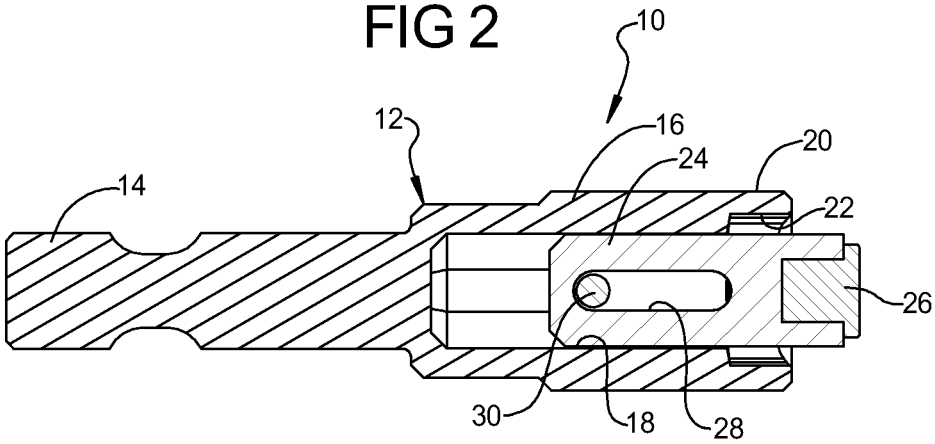
FIG. 3 is a cross-sectional view of the cleanable magnetic nut driver shown in FIG. 1, with the shaft having a magnetic front portion extended so as to be exposed from the socket for cleaning.

With reference to FIGS. 1-3, a cleanable magnetic nut driver 10 according to the principles of the present disclosure will now be described.

The cleanable magnetic nut driver 10 includes a shank 12 having a rear portion 14 configured to be coupled to a power tool. The shank includes an intermediate portion 16 defining an internal bore 18. The shank 12 also includes a front portion 20 defining a hex-shaped socket 22 in communication with the bore 18.

A magnet holder 24 is received in the bore 18 and includes a magnetic front portion 26. The magnet holder 24 is slidable between a rearward position, as shown in FIG. 2, where the magnetic front portion 26 is at a rearward end of the socket 22 and a forward position, as shown in FIG. 3, where the magnetic front portion 26 is exposed from the socket 22 for cleaning. The magnet holder 24 can include an elongated slot 28 extending transversely therethrough that receives a retaining pin 30 that limits the axial movement of the magnet holder 24 within the bore 18. The retaining pin 30 can be received in opposing apertures 32 provided in the wall of the intermediate portion 16 of the shank 12.

An actuator 34 can extend external to the shank 12 through an elongated slot 36 provided in the wall of the intermediate portion 16 of the shank 12. The actuator 34 is fixedly coupled to the magnet holder 24. The actuator 34 is movable between a first position in which the magnet holder 24 is moved to the rearward position as illustrated in FIG. 2 so that the magnet holder is fully retracted within the bore 18. The actuator is movable to a second position, as illustrated in FIG. 3, to move the magnet holder 24 to the frontward position where the magnetic front portion 26 is exposed for cleaning. A retaining mechanism such as a detent can be provided along the slot 36 in the shank or can otherwise be provided on the actuator 34 for releasably holding the actuator in either the first position or the second position. It is anticipated, that other alternative retaining mechanisms could be used.

Figure 6:
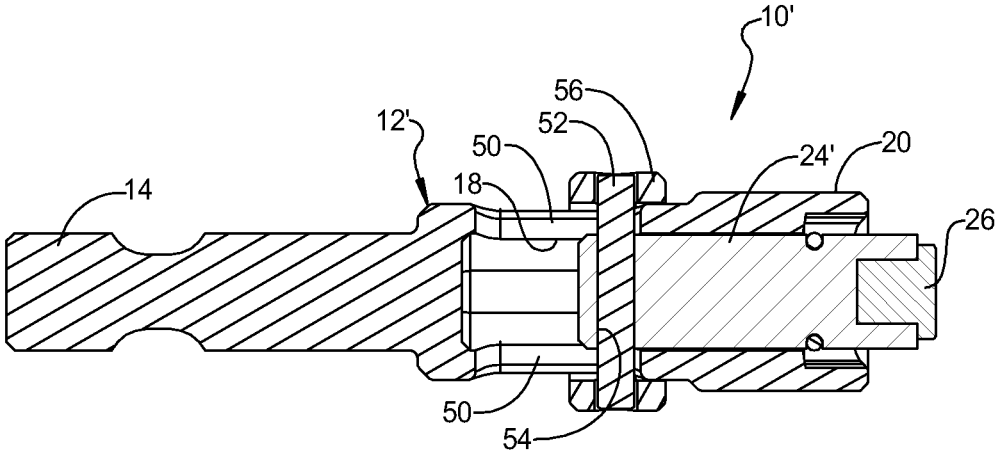
FIG. 6 is a cross-sectional view of the cleanable magnetic nut driver shown in FIG. 4, with the shaft having a magnetic front portion extended so as to be exposed from the socket for cleaning.
Figure 7:
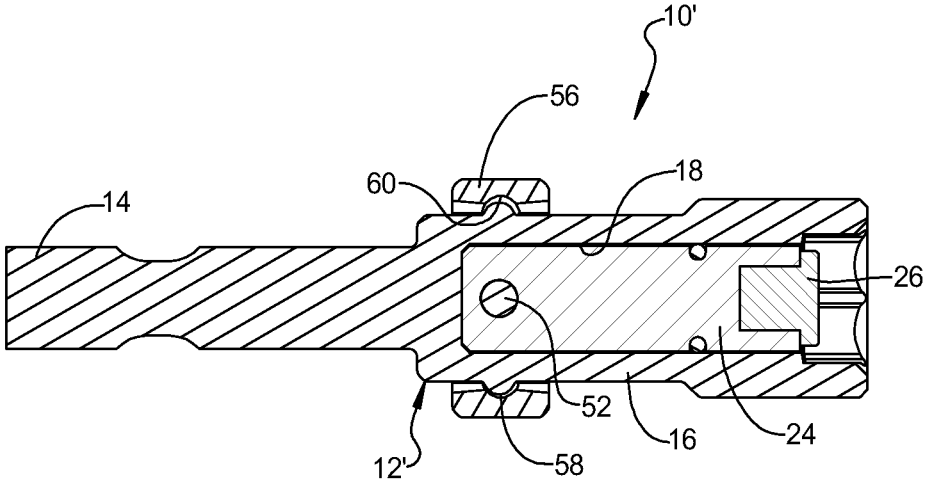
FIG. 7 is a cross-sectional view of the cleanable magnetic nut driver shown in FIG. 4 taken from a different angle than FIG. 5, with the shaft having a magnetic front portion which is fully received within the bore.
Figure 10A:
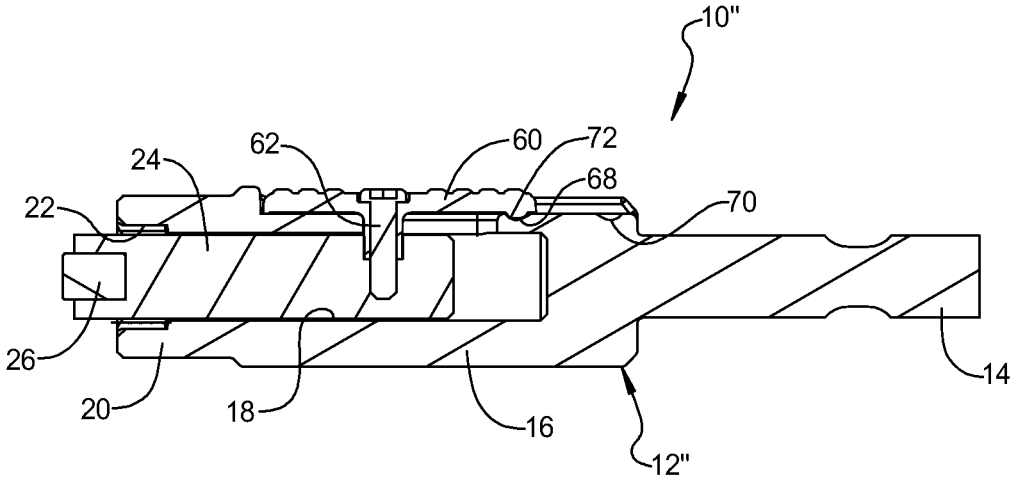
FIG. 10A is a cross-sectional view of the cleanable magnetic nut driver taken along lines 10A-10A of FIG. 9A, with the shaft having a magnetic front portion extended so as to be exposed from the socket for cleaning.

With reference to FIGS. 4-7, a cleanable magnetic 10' according to an alternative embodiment will now be described. The cleanable magnetic nut driver 10' includes a shank 12' having a rear portion 14 configured to be coupled to a power tool and an intermediate portion 16 defining an internal bore 18 and a front portion 20 defining a hex-shaped socket 22 in communication with the bore 18. A magnet holder 24' is slidably received in the bore 18 of the intermediate portion 16 and includes a magnetic front portion 26. The intermediate portion 16 includes a pair of axially extending slots 50 communicating with the bore 18 and receiving a transverse pin 52 through each slot 50. The transverse pin 52 is received in an aperture 54 extending through the magnet holder 24' at a rear end thereof. A slide collar 56 can receive the transverse pin 52 and serves as an actuator for allowing the user to slide the magnet holder 24' from a rearward use position as illustrated in FIG. 5 to a forward cleaning position as illustrated in FIG. 6. The shank 12' can be provided with a detent 58 on a surface thereof for engaging with a recess 60 on an interior surface of the collar 56 in order to retain the magnet holder 24' in the rearward position, as illustrated in FIG. 7. Additional detents could also be utilized for retaining the magnet holder 24' in the forward position, if desired.

Figure 11A:
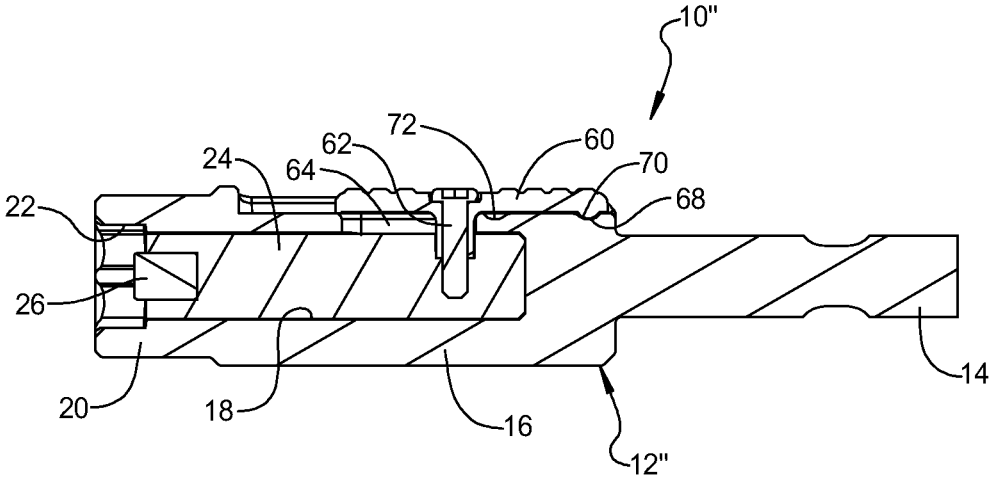
FIG. 11A is a cross-sectional view of the cleanable magnetic nut driver taken along lines 10A-10A of FIG. 9A, with the shaft having a magnetic front portion which is fully received within the bore.
Figure 9B:
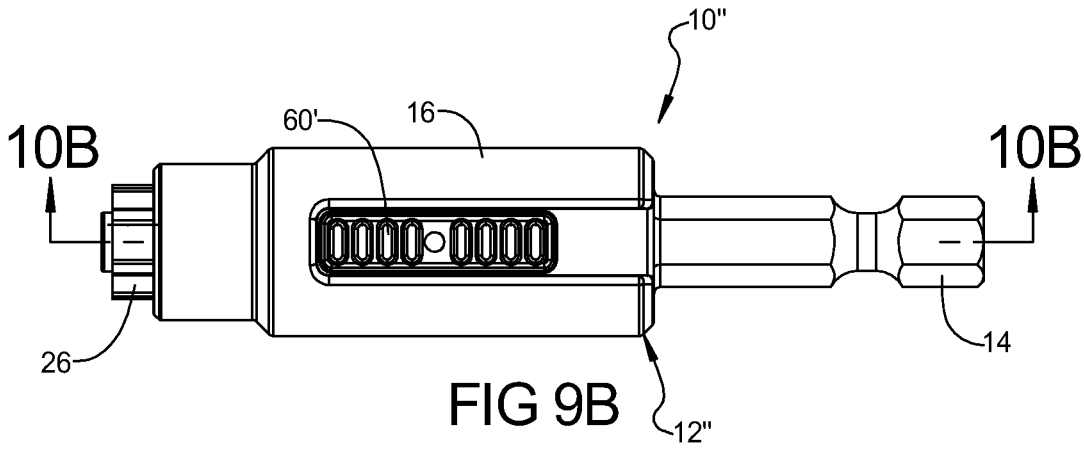
FIG. 9B is a plan view of the cleanable magnetic nut driver shown in FIG. 8, with the shaft having a magnetic front portion extended so as to be exposed from the socket for cleaning according to an alternative embodiment.
Figure 10B:
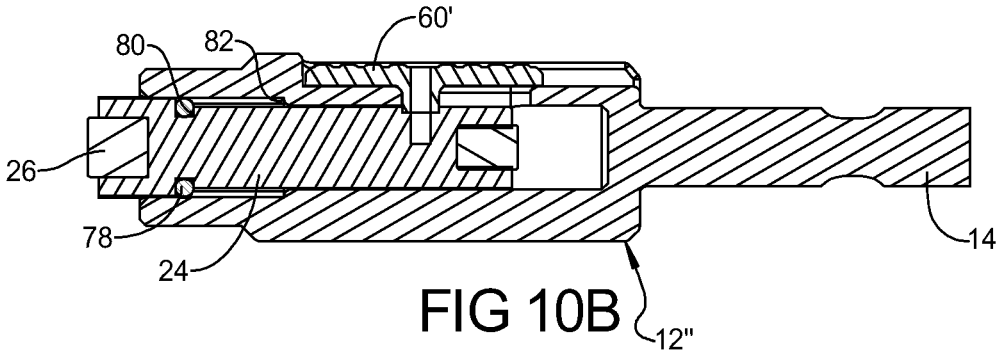
FIG. 10B is a cross-sectional view of the cleanable magnetic nut driver taken along lines 10B-10B of FIG. 9B, with the shaft having a magnetic front portion extended so as to be exposed from the socket for cleaning.
Figure 11B:
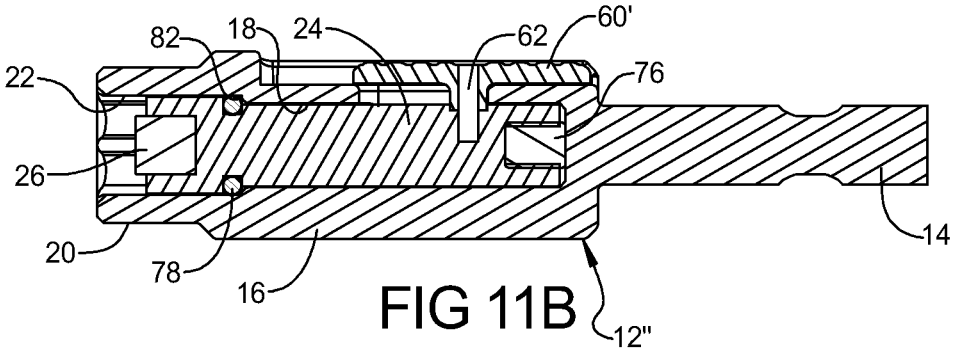
FIG. 11B is a cross-sectional view of the cleanable magnetic nut driver taken along lines 10-10 of FIG. 9B, with the shaft having a magnetic front portion which is fully received within the bore.
Figure 11C:
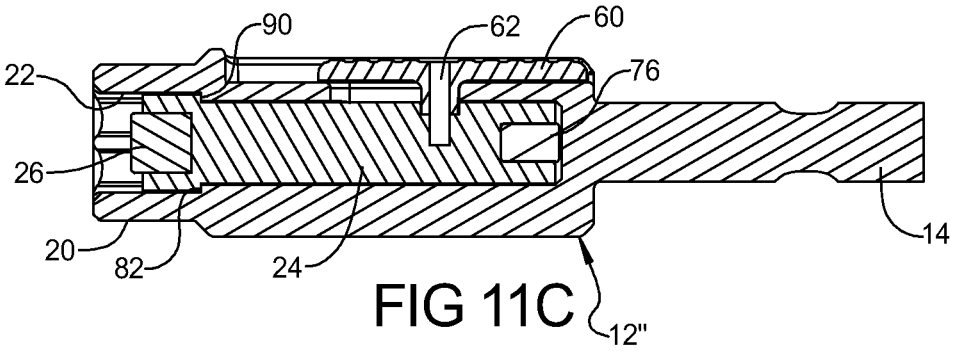
FIG. 11C is a cross-sectional view of the cleanable magnetic nut driver, with the shaft having a magnetic front portion which is fully received within the bore according to an alternative embodiment.

With reference to FIGS. 8 and 9A-11A, a cleanable magnetic nut driver 10" according an alternative embodiment will now be described. The cleanable magnetic nut driver 10" includes a shank 12" having a rear portion 14 configured to be coupled to a power tool. An intermediate portion 16 defines an internal bore 18 and a front portion 20 defines a hex-shaped socket 22 in communication with the bore 18. A magnet holder 24 is received in the bore 18 and includes a magnetic front portion 26. The magnet holder is slidable between a rearward position, as best illustrated in FIG. 11, wherein the magnetic front portion 26 is disposed rearward of the socket 22 and a forward position, best shown in FIG. 10 where the magnetic front portion 26 is exposed from the socket 22 for cleaning. An actuator plate 60 is disposed external to the shank 12" and is fixedly coupled to the magnet holder 24 via a post 62 that extends through a longitudinal slot 64 in the sidewall of the intermediate portion 16 of the shank 12". The actuator plate 60 allows a user to slide the actuator plate 60 to cause the magnet holder 24 to move from its rearward and forward positions. The plate 60 can include a detent 68, shown in its rearward end that can be received within one of the recesses 70, 72 provided in the surface of the intermediate portion 16 of the shank 12'. The recesses 70, 72 are provided at axially spaced rearward and forward positions in order to retain the plate 60 and magnet holder 24 in either of its rearward or forward positions, respectively.

As illustrated in FIGS. 9B-11B, the detent 68 on the actuator plate 60 and the recesses 70, 72 on the shank 12" can be eliminated and replaced with a magnet 76 disposed on a rear end of the magnet holder 24. The magnet 76 is attracted to the rearward end of the bore 18 and helps to maintain the magnet holder 24 in a rearward position during use. An O-ring 78 can also be utilized in a recess 80 surrounding the magnet holder 24. The O-ring provides a tight engagement with the inner walls of the hexagonal socket 22 to prevent contaminants from entering the bore 18. The O-ring 78 also provides resistance to free movement of the magnet holder 24 within the bore 18. The O-ring 78 can seat against a shoulder 82 where the socket portion 22 transitions to the bore 18. As seen in FIG. 11C, the O-ring can be eliminated and the magnet holder 24' can be provided with a rearward facing shoulder 90 that seats against the forward facing shoulder 82 to help prevent contaminants from entering the bore 18.

With reference to FIGS. 12-14, a cleanable magnetic nut driver 110 according to an alternative embodiment will now be described. The cleanable magnetic nut driver 110 includes a shank 112 having a rear portion 114 configured to be coupled to a power tool and a front magnetic portion 116, best shown in the cross-sectional view of FIG. 14. A sleeve 118 is received over the shank 112 and includes a front portion 120 defining a hex-shaped socket 122 and a rear portion 124 defining a bore 126 in communication with the socket 122 and received over the front magnetic portion 126 of the shank 112. An actuator 128 extends external to the sleeve 118 and is configured to prevent movement of the sleeve 118 relative to the shank 112 when not actuated. The actuator 128 is configured to enable movement of the sleeve 118 relative to the shank 112 when actuated. The actuator can include a release pin 128 that is adapted to engage a lateral travel pin 130 that is received in a bore 132 in the shank 112. The lateral travel pin 130 is biased by a spring 134 so as to provide engagement with the bore 136 that receives the release pin 128 when the bore 136 is aligned with the lateral travel pin 130. By pressing the release pin 128, the user can disengage the lateral travel pin 130 from engagement with the bore 136 in the sleeve 118 to allow the sleeve 118 to move to a rearward position as illustrated by arrow A so that the front magnetic portion 116 can be exposed for cleaning. A c-clip or o-ring 140 can be provided in a recessed groove 142 provided in the shank 112 for engaging an interior shoulder 144 disposed within the bore 126 of the sleeve 118 to provide a limit on the rearward motion on the sleeve 118. The limited axial motion of the sleeve 118 is sufficient to allow exposure of the front magnetic portion 116 to allow the magnetic portion 116 to be cleaned. The sleeve 118 is then moved to a forward position wherein the lateral travel pin 130 is aligned with the bore 136 for retaining the sleeve 118 in its forward, use position. As illustrated in FIG. 14, the forward magnetic portion 116 can be secured to the shank 112 by a cup-shaped housing 150 and post 152 which are used to secure the magnet 116 to the shank 112. Alternative methods of fastening the magnet 116 to the shank 112 can also be utilized.

Figure 15:
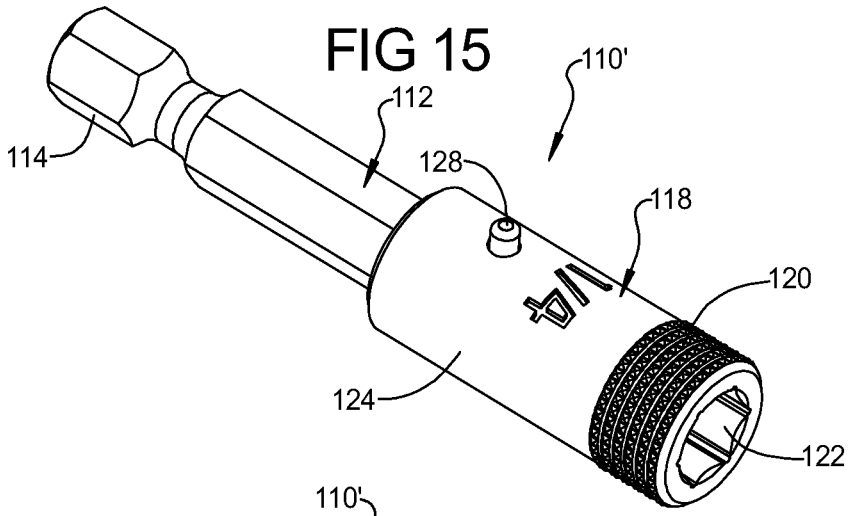
FIG. 15 is a perspective view of a cleanable magnetic nut driver according to a further embodiment.
Figure 16:
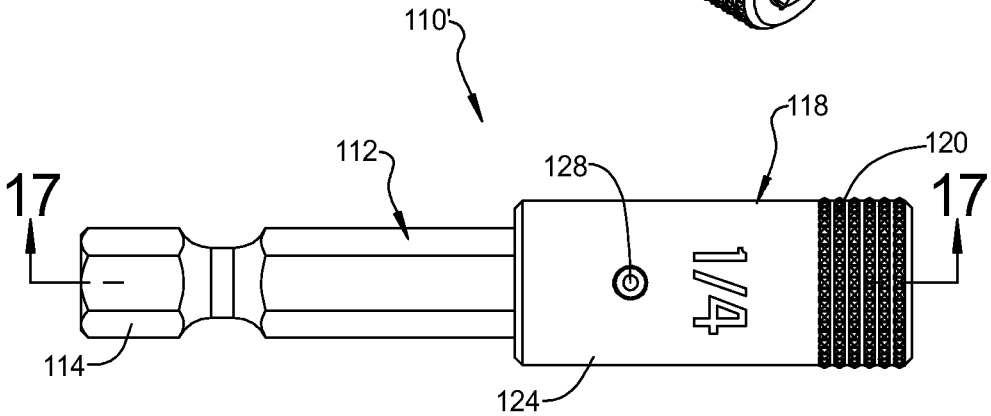
FIG. 16 is a plan view of the cleanable magnetic nut driver shown in FIG. 15.
Figure 17:
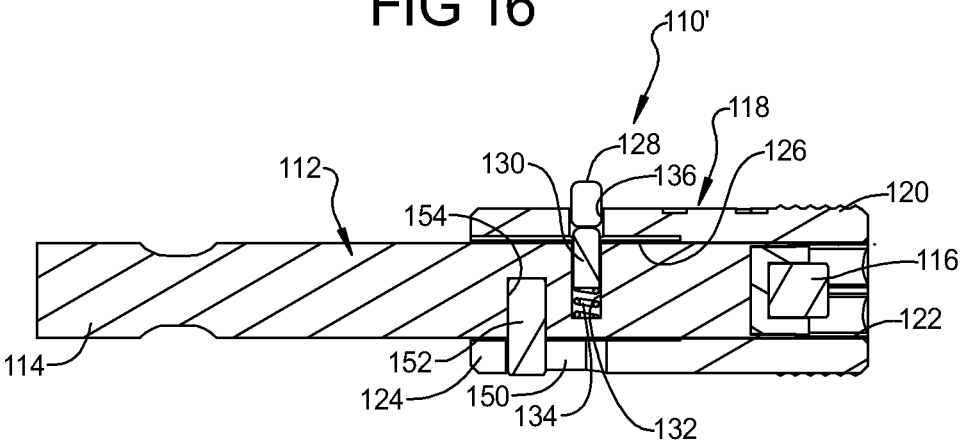
FIG. 17 is a cross-sectional view of the cleanable magnetic nut driver taken along line 17-17 of FIG. 16.
Figure 18:
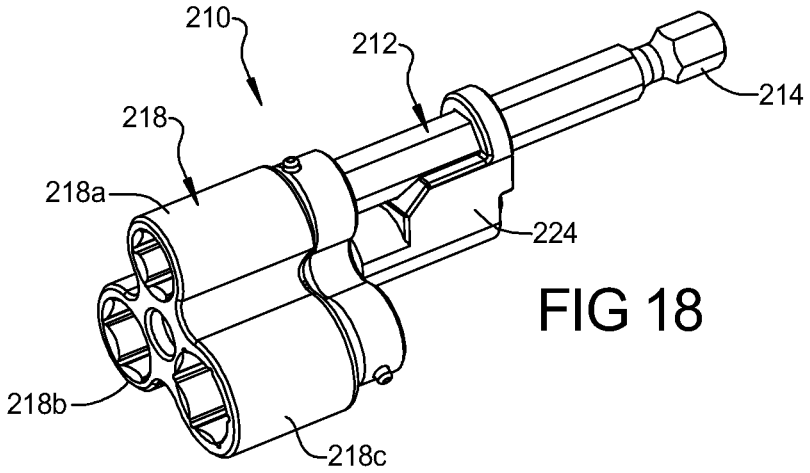
FIG. 18 is a perspective view of a three-size cleanable nut driver according an alternative embodiment.

With reference to FIGS. 15-17, a cleanable magnetic nut driver 110' according to an alternative embodiment will now be described. The cleanable magnetic nut driver 110' includes a shank 112 having a rear portion 114 configured to be coupled to a power tool and a front magnetic portion 116, as best shown in FIG. 17. A sleeve 118 is received over the shank 112. The sleeve has a front portion 120 defining a hex-shaped socket 122. A rear portion 124 of the sleeve 118 defines a bore 126 in communication with the socket 122 and received over the front magnetic portion 116 of the shank 112. An actuator 128 in the form of a release pin 128 can engage a lateral travel pin 130 that is received in a lateral bore 132 of the shank 112. A biasing spring 134 is provided in the bore 132 for biasing the lateral travel pin 130 in a radially outward direction. The lateral travel pin 130 can be received in a bore 136 that receives the release pin 128 for retaining the sleeve 118 in a fixed forward position as illustrated in FIG. 17. The sleeve 118 can include an elongated slot 150 for receiving a guide pin 152 that is received in a bore 154 in the shank 112. The guide pin 152 engages the slot 150 in order to limit the axial travel of the sleeve 118 from its forward position to a rearward position that allows the front magnetic portion 116 to be exposed for cleaning. In the embodiment of FIGS. 15-17, the guide pin 152 and axially extending slot 150 in sleeve 118 take the place of the retainer clip 140, shown in the embodiment of FIGS. 12-14, in limiting the axial movement of the sleeve 118.

Figure 19:
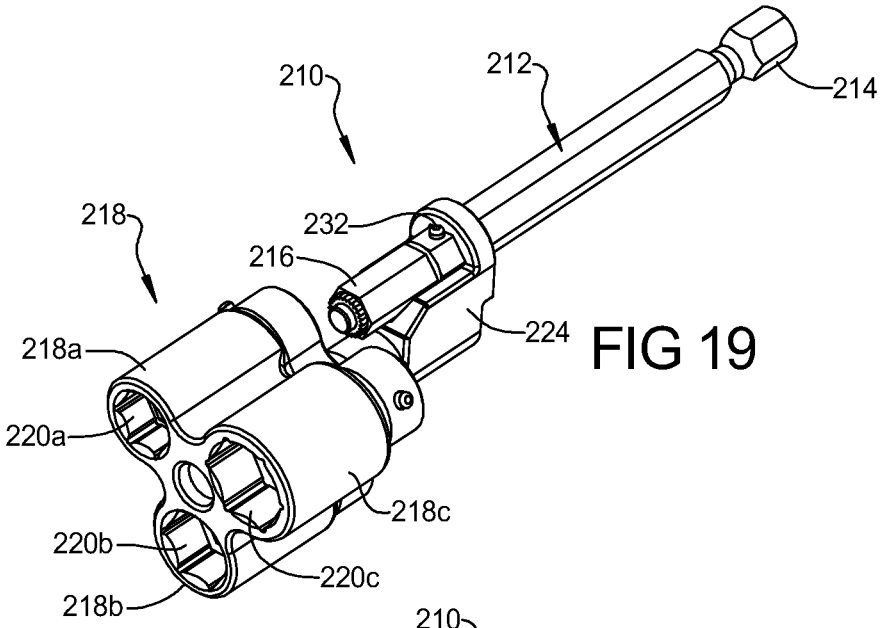
FIG. 19 is a perspective view of the three-size cleanable magnetic nut driver shown with the magnet exposed for removal of metal chips.
Figure 20:
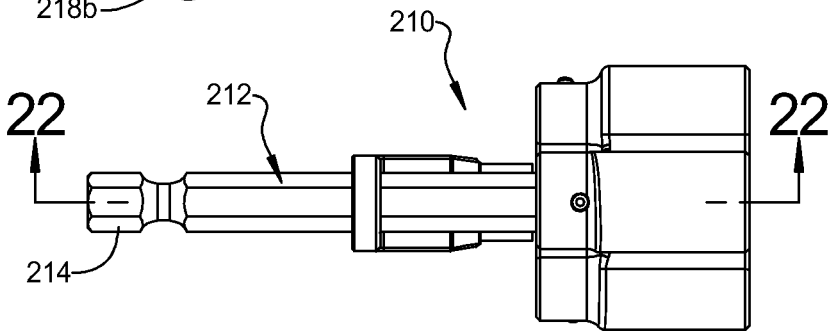
FIG. 20 is a plan view of the three-size cleanable magnetic nut driver shown in FIGS. 18 and 19.
Figure 21:
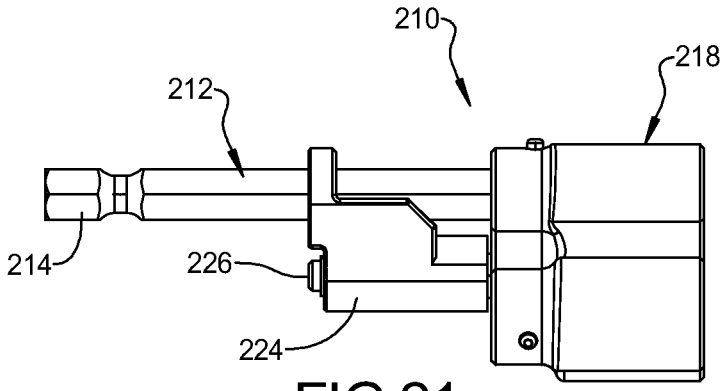
FIG. 21 is a side-plan view of the three-size cleanable magnetic nut driver shown in FIGS. 18 and 19.
Figure 22:
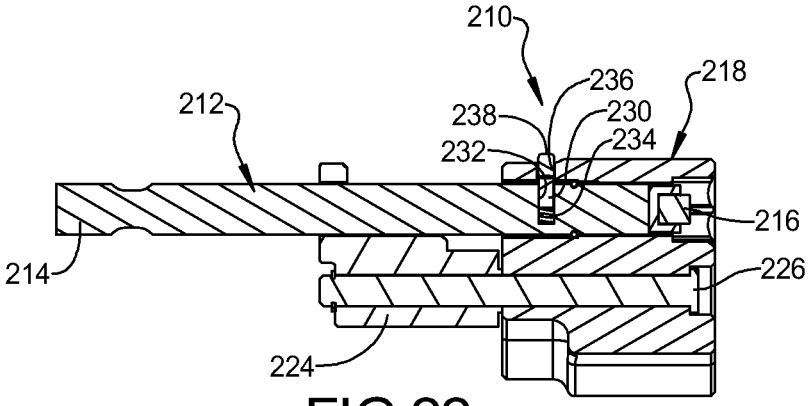
FIG. 22 is a cross-sectional view of the three-size cleanable magnetic nut driver taken along line 22-22 of FIG. 20.
Figure 23:
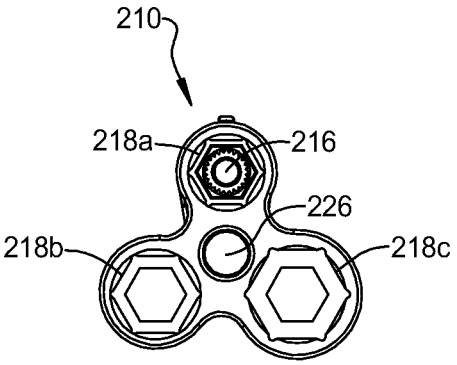
FIG. 23 is an end-plan view of the three-size cleanable magnetic nut driver shown in FIGS. 18 and 19.
Figure 24:
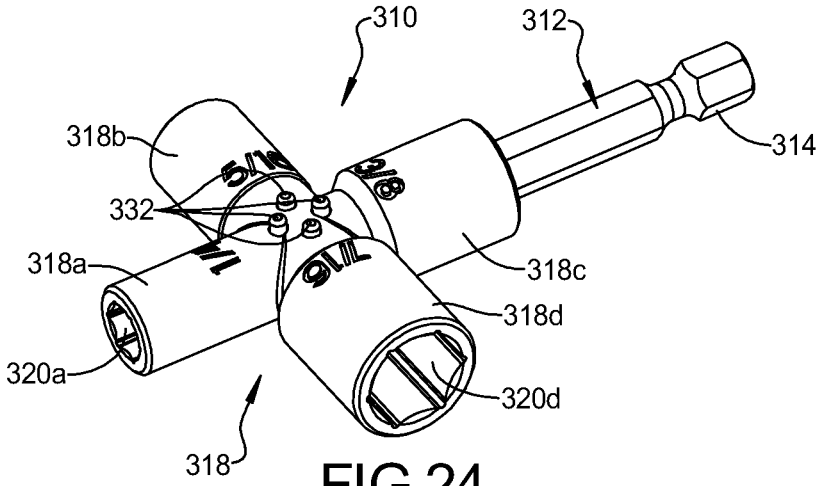
FIG. 24 is a perspective view of a four-size cleanable magnetic nut driver according to the principles of the present disclosure.
Figure 25:
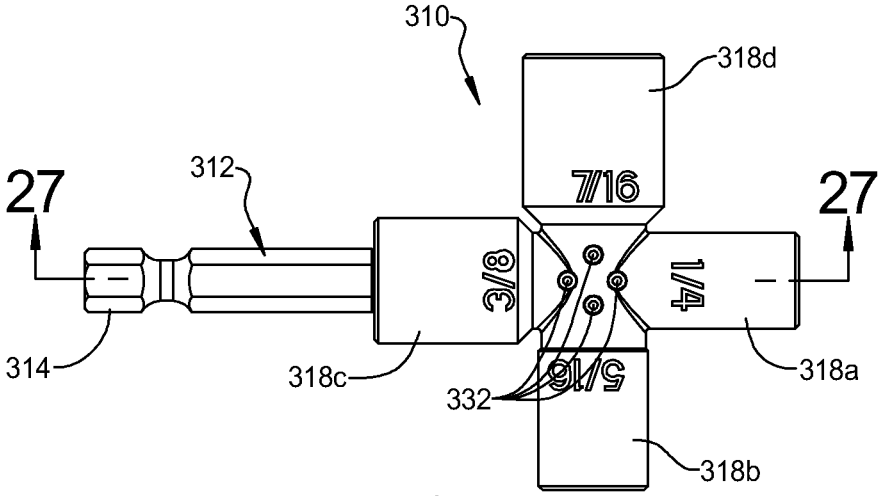
FIG. 25 is a top-plan view of the four-size cleanable magnetic nut driver shown in FIG. 24.
Figure 26:
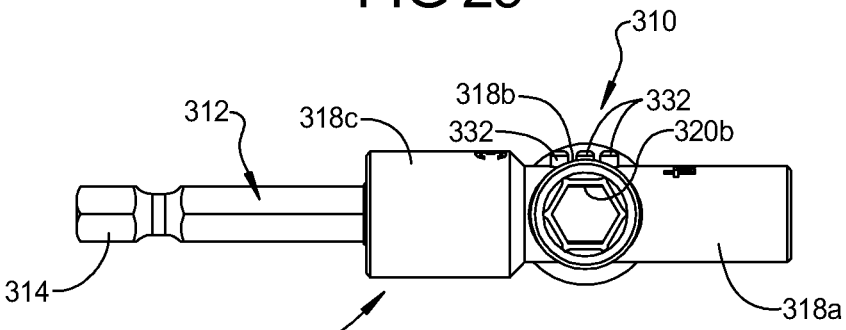
FIG. 26 is a side-plan view of the four-size cleanable magnetic nut driver shown in FIG. 24.

With reference to FIGS. 18-23, a three-size cleanable magnetic nut driver 210 according to an alternative embodiment will now be described. The three-size cleanable magnetic nut driver 210 includes a shank 212 having a rear portion 214 configured to be coupled to a power tool and a front magnetic portion 216, as best illustrated in FIGS. 19 and 22. A socket assembly 218 includes a plurality of sockets **218*a*-218*c* each fixed together and each having a forward open end with different sized polygonal cavities 220*a*-220*c*. The socket assembly 218 is removably attached to the shank 212 in a plurality of positions so that the forward opened end of each of said plurality of sockets 218*a*-218*c* can be separately replaced in an operable position and axially aligned with the shank 212. The rear end portion of the each of the sockets 218*a*-218*c* includes a polygonal bore that mates with the shank 212 forward end so that the front magnetic portion 216 is disposed adjacent to the different sized polygonal cavities of each of the sockets 218*a*-218*c*. The socket assembly 218 can include a sleeve 224 that is slidably mounted on the shank 212 and the plurality of sockets 218*a*-218*c* are rotatably mounted to the sleeve 224 by a support shaft 226 as best shown in FIGS. 22 and 23**.

The shank 212 can include a transverse bore 230 that receives a lateral travel pin 232 therein. A spring 234 can be provided in the bore 230 for biasing the lateral travel pin 232 to a radially outward position. Each of the sockets **218*a*-218*c* can be provided with a corresponding bore 236 that receives a release pin 238 therein. In the assembled position, the sockets 218*a*-218*c* are received on the forward end of the shank 212 until the bore 236 in each socket is aligned with the lateral travel pin 232 for retaining the socket 218*a*-218*c* to the shank 212. In order to remove each socket 218*a*-218*c*, the release pin 238 thereon is depressed thereby forcing the lateral travel pin 232 out of engagement with the bore 236 in the respective socket 218*a*-218*c*. Once the socket 218*a*-218*c* is removed from the shank, the magnetic front portion 216 is exposed and can be easily cleaned. The socket assembly 218 can then be rotated about the guide pin 226 to a desired location so that the socket 218*a*-218*c* can be fixed to the shank 212 for use. As illustrated in FIG. 19, the lateral travel pin 232 can serve as a stop surface for engaging the sleeve 224 to prevent the sleeve 224 from being removed from the shank 212. It is noted that for easy assembly of each of the sockets 218*a*-218*c* onto the shank 212, a rear beveled edge can be provided that would slidably engage the top of the lateral travel pin 232 to press the lateral travel pin radially inward as the socket 218*a*-218*c* is slid onto the shank 212 until the lateral travel pin engages the bore 236 in the respective socket 218*a*-218*c*. With the proposed design of FIGS. 18-23**, the use of a plurality of different sized nut drivers can be utilized with the tool while also providing the capability of cleaning the magnet for efficient operation of the nut driver.

Figure 27:
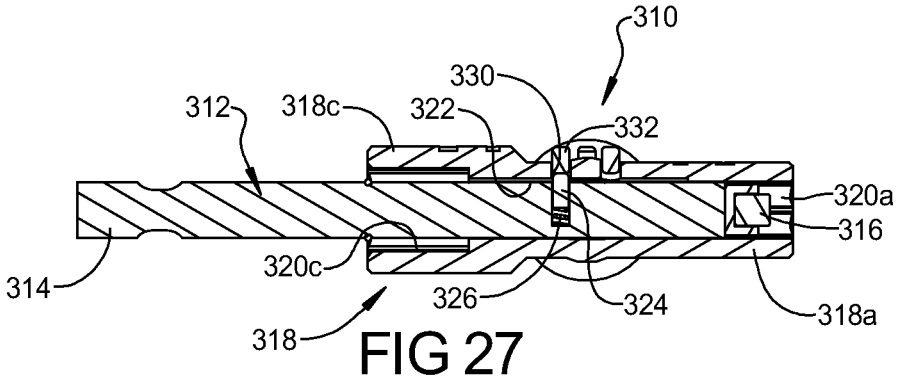
FIG. 27 is a cross-sectional view of the four-size cleanable magnetic nut driver taken along line 27-27 of FIG. 25.

With reference to FIGS. 24-27, a four-size cleanable magnetic nut driver 310 will now be described. The four-size cleanable magnetic nut driver 310 includes a shank 312 having a rear portion 314 configured to be coupled to a power tool and front magnetic portion 316, as best shown in FIG. 27. A socket portion 318 includes a plurality of different sized sockets 318*a*-318*d* each defining a bore and a hex-shaped socket forward of the bore, each socket having a different size. The socket assembly 318 is removably attached to the shank 312 in a plurality of positions so that the forward open end of each of said plurality of sockets 318*a*-318*d* can be separately placed in an operable position axially aligned with the shank 312. Each of the different sized polygonal cavities 320*a*-320*d* of each of the sockets 318*a*-318*d* communicates with a polygonal bore that mates with the shank 312.

The shank 312 can include a lateral travel pin 324 received in a lateral bore 326 that is biased in an outward direction by a spring (not shown). The lateral travel pin 324 can be aligned with and received in a corresponding bore 330 provided in association with each of the sockets 318*a*-318*d* in each of the bores 330, a release pin 332 is provided for disengaging the lateral travel pin 324 from the socket assembly 318 to allow the socket assembly to be removed from the shank 312. When the socket assembly 318 is removed from the shank 312, the front magnetic portion 316 is exposed and can be easily cleaned. The socket assembly 318 can then be properly oriented onto the shank 312 so that the selected socket size can be utilized. With the tool 310 as shown, the use of four different sized sockets can be utilized with a single shank while the sockets can be removable to allow easy cleaning of the magnet for more efficient use of the nut driver.

Figure 28:
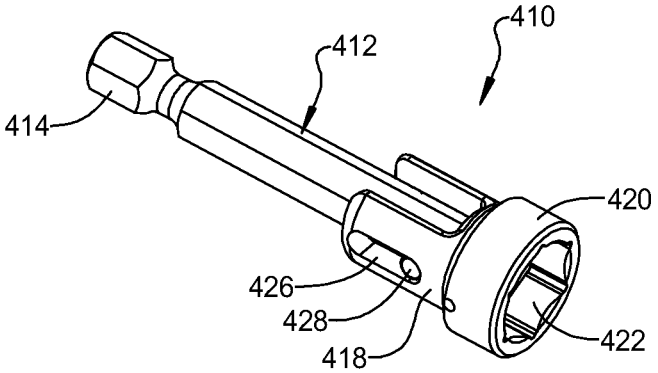
FIG. 28 is a perspective view of a cleanable magnetic nut driver according to an alternative embodiment of the present disclosure.
Figure 29:
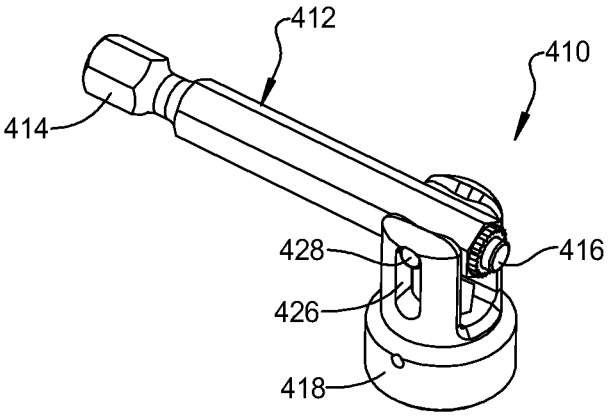
FIG. 29 is a perspective view of the cleanable magnetic nut driver shown in FIG. 28 with the pivoting sleeve moved to a downward position to expose the magnet for cleaning.

With reference to FIGS. 28 and 29, a cleanable magnetic nut driver 410 according to an alternative embodiment will now be described. Cleanable magnetic nut driver 410 includes a shank 412 having a rear portion 414 configured to be coupled to a power tool and a front magnetic portion 416, as best shown in FIG. 29. A sleeve 418 is received over the shank 412 and includes a front portion 420 defining a hex-shaped socket 422 and a rear portion defining a bore in communication with the socket and received over the front magnetic portion of the shank 412. The sleeve 418 includes a pair of elongated longitudinally extending slots 426 disposed on opposite sides thereof for receiving a guide pin 428 extending laterally from opposite sides of the shank 412. In its operating position, the sleeve 418 is slid over the shank 412 so that the hex-shaped socket 422 is axially aligned with the shank 412 and the guide pin 426 is received at a forward end of the elongated slot 426. In order to clean the front magnetic portion 416 of the shank 412, the sleeve 418 can be slid in a forward direction so that the guide pin 428 is received at a rearward end of the elongated slots 426 and the sleeve 418 can be pivoted about the guide pin 428 away from the front magnetic portion 416 so that the front magnetic portion 416 is exposed and can be cleaned. In order to resume use of the cleanable magnetic nut driver 410, the sleeve 418 is then pivoted about the guide pin 428 such that the hex-shaped socket 422 is axially aligned with the shank 412 and the sleeve 418 is slid rearwardly onto the shank 412. It should be understood that in each of the above described embodiments, numerous features are disclosed that can be used in other embodiments.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A nut driver comprising:

a shank having a rear portion configured to be coupled to a power tool, an intermediate portion defining an internal bore, and a front portion defining a hex-shaped socket in communication with the bore;

a magnet holder received in the bore, the magnet holder having a magnetic front portion and a magnetic rear portion, the magnet holder being slidable between a rearward position where the magnetic front portion is disposed rearward of the socket, and a frontward position where the magnetic front portion is exposed from the socket for cleaning; and an actuator external to the shank and fixedly coupled to the magnet holder through a slot in a sidewall of the intermediate portion of the shank, the actuator moveable between a first position in which the actuator causes the magnet holder to move to the rearward position, and a second position in which the actuator causes the magnet holder to move to the frontward position, wherein the magnetic rear portion attracts the magnet holder toward a rear end of the internal bore.

2. The nut driver of claim 1, further comprising a retaining mechanism disposed on at least one of the shank and the actuator for releasably holding the actuator in at least one of the first position and the second position.

3. The nut driver of claim 2, wherein the retaining mechanism comprises a detent on one of the shank and the actuator and a recess on the other of the shank and the actuator.

4. The nut driver of claim 2, wherein the retaining mechanism releasably holds the actuator in the first position.

5. The nut driver of claim 1, further comprising a stop for preventing travel of the magnet holder forward beyond the frontward position.

6. The nut driver of claim 1, wherein said internal bore defines a forward facing shoulder and said magnet holder defines a rearward facing shoulder adapted to directly engage said forward facing shoulder when said magnet holder is in said rearward position.

7. The nut driver of claim 6, wherein said rearward facing shoulder on the magnet holder includes an O-ring disposed thereon that engages said forward facing shoulder when said magnet holder is in said rearward position.

8. The nut driver of claim 1, wherein the magnet holder is attracted to the rear end of the bore independent of a spring force.

9. A fastener driving tool comprising:

an outer shaft having a shank configured to be coupled to a power tool, and a sleeve having a front end defining an internal bore, and a rear end fixedly coupled to the shank;

an inner shaft having a magnetic front end portion and a magnetic rear portion, the inner shaft received in the bore and moveable between a rear position in which the magnetic front end portion is disposed within the bore rearward of the sleeve front end, and a front position where the magnetic front end portion is exposed from the sleeve for cleaning;

and an actuator coupled to at least one of the inner shaft and the outer shaft to enable manual movement of the inner shaft between the rear position and the front position, wherein the magnetic rear portion attracts the inner shaft toward a rear end of the internal bore.

10. The fastener driving tool of claim 9, further comprising a retaining mechanism disposed on at least one of the inner shaft, the outer shaft, and the actuator for releasably holding the inner shaft in at least one of the front position and the rear position.

11. The fastener driving tool of claim 10, wherein the retaining mechanism comprises a detent on one of the outer shaft and the actuator and a recess on the other of the outer shaft and the actuator.

12. The fastener driving tool of claim 10, wherein the retaining mechanism releasably holds the actuator in the front position.

13. The fastener driving tool of claim 9, further comprising a stop for preventing travel of the inner shaft forward beyond the front position.

14. The fastener driving tool of claim 9, wherein the internal bore defines a forward facing shoulder and inner shaft defines a rearward facing shoulder adapted to directly engage said forward facing shoulder when the inner shaft is in the rear position.

15. The fastener driving tool of claim 14, wherein the rearward facing shoulder on the inner shaft includes an O-ring disposed thereon that engages said forward facing shoulder when inner shaft is in the rearward position.

16. The fastener driving tool of claim 9, wherein the inner shaft is attracted to the rear end of the bore independent of a spring force.

17. A fastener driving tool comprising:

an outer shaft having a shank portion configured to be coupled to a power tool, and a sleeve portion having a front end portion defining an internal bore, and a rear end portion coupled to the shank;

an inner shaft including a frontward facing magnetic portion and a rearward facing magnetic portion, the shaft received in the bore and moveable between a rear position in which the frontward facing magnetic front end portion is disposed within the bore rearward of the sleeve front end, and a front position where the magnetic front end portion is exposed from the sleeve for cleaning; and an actuator coupled to at least one of the inner shaft and the outer shaft to enable manual movement of the inner shaft between the rear position and the front position, wherein the rearward facing magnetic portion attracts the inner shaft toward the rear end portion of the outer shaft to bias the inner shaft toward the rear position.

* * * * *